United States Patent [19]

Robinson et al.

[11] Patent Number: 4,661,893

[45] Date of Patent: Apr. 28, 1987

[54] UNDERWATER LIGHTING SYSTEM

[75] Inventors: Alan S. Robinson, El Monte; Mark W. Fuller, Studio City, both of Calif.

[73] Assignee: Wet Enterprises, Inc., Burbank, Calif.

[21] Appl. No.: 801,465

[22] Filed: Nov. 25, 1985

[51] Int. Cl.[4] ..... F21Y 29/00

[52] U.S. Cl. ..... 362/267; 362/101; 362/318; 362/331

[58] Field of Search ..... 362/267, 318, 96, 332, 362/331, 101, 309, 154, 326, 806

[56] References Cited

U.S. PATENT DOCUMENTS

| | | | |
|---|---|---|---|
| 1,871,742 | 8/1932 | Sabath | 362/101 |
| 1,968,072 | 7/1934 | Creighton | 362/267 |
| 2,051,175 | 8/1936 | Nightingale | 362/267 |
| 2,481,054 | 9/1949 | Wendel | 362/318 |

*Primary Examiner*—E. Rollins Cross

*Attorney, Agent, or Firm*—Blakely, Sokoloff, Taylor & Zafman

[57] ABSTRACT

An underwater lighting system for the illumination of decorative water displays and the like is disclosed. Each light in a typical lighting system is disposed below the surface of the water, with the light source having a flat lens to avoid the spreading of the rays due to the index of refraction of the water. Disposed over the light source with the upper surface thereof above the water surface and the lower surface thereof below the water surface is a light guide for allowing the passage of light therethrough substantially perpendicular to the upper and lower surfaces, though at the same time substantially inhibiting light from passing therethrough which is not substantially perpendicular to the surfaces of the light guide, at least with respect to one transverse axis thereof. In this manner, the normal diffusing of underwater lighting encountered in water display caused by ripples in the pool are avoided because of the upper surface of the light guide being above the water level. The net result is that light passing directly from the light source to the eyes of the display observer is held to a minimum, as is the intermixing of light from multiple light sources, thereby making the light sources substantially invisible to the observer and allowing illumination of the water display with multiple lights of different colors in a pleasing and effective manner. Various embodiments are disclosed.

19 Claims, 13 Drawing Figures

UNDERWATER LIGHTING SYSTEM

BACKGROUND OF THE INVENTION

1. Field of the Invention

The present invention relates to the field of underwater lighting systems and more particularly, to underwater lighting systems for the illumination of decorative water displays and the like.

2. Prior Art

Decorative water displays, or fountains as they are often called, of very elaborate designs and characteristics are often used for the aesthetic enhancement of buildings, shopping centers and the like. Such water displays may be substantially static, or with the advent of computer control, may provide constantly changing displays for even greater interest and aesthetic appeal. Typically such displays are lighted at night by high intensity lights disposed beneath the water level in a pool surrounding the water display, with the lights illuminating the display from the viewing sides so that the entire height of the water may be illuminated. Such lighting grossly enhances the appearance of the display, and in most cases is either the only form of lighting reasonably practical, or at least is the least intrusive.

Conventional underwater lighting systems have certain characteristics which are less than ideal, and which limit the visual effects which may be obtained thereby. One of these characteristics is the tendency of underwater lights to give off some light which ultimately proceeds from the light source, through the water surface and directly to the observer's eye rather than passing to the water display for illumination thereof. This creates an apparent glare just below the water display, having a substantial veiling effect on the illuminated water display itself.

The direct transmission of light to the eyes of the observer of the water display is caused by a number of factors characteristic of prior art lighting systems. The first, of course, is the lack of focus of the light source itself. Generally lights used underwater have a curved lens, with the result that the index of refraction of the water causes a spreading of the light rays upon entering the water, even if the light was reasonably well focused within the light source itself. While underwater lighting units having a flat lens at the lens-water interface are known, such as shown in U.S. Pat. No. 1,968,072, such flat lenses are frequently used, as in that patent, in swimming pools wherein dispersed lighting rather than focused lighting is desired.

U.S. Pat. No. 2,481,054 discloses a light projector which is configured to minimize light passing substantially along a line of sight between the light projector and a water display observer by blocking that light from the sides and using a concave lens over the light. That system does not address another major cause of light passing directly to the observer's eyes, specifically the effect of ripples on the top of the pool of water caused by and constantly present due to the water display itself. Consequently, even the best focussed underwater light unit will still result in substantially dispersed light upon passing through the real water-air interface at the surface of the pool, again causing some veiling effect.

The light dispersion at the surface of the pool has another undesirable effect. In particular, lighting a water display with a colored light causes the water display to appear to itself be comprised of glowing colored water. Ideally in some instances one would like to illuminate different parts of the display with different colors to further enhance the appearance thereof. However, when one attempts this with prior art lighting systems, the dispersion of the light caused by the water surface, either alone or in conjunction with other factors, results in the intermixing of the various colors, which of course results in white light, contrary to the desired result.

BRIEF SUMMARY OF THE INVENTION

An underwater lighting system for the illumination of decorative water displays and the like is disclosed. Each light in a typical lighting system is disposed below the surface of the water, with the light source having a flat lens to avoid the spreading of the rays due to the index of refraction of the water. Disposed over the light source with the upper surface thereof above the water surface and the lower surface thereof below the water surface is a light guide for allowing the passage of light therethrough substantially perpendicular to the upper and lower surfaces, though at the same time substantially inhibiting light from passing therethrough which is not substantially perpendicular to the surfaces of the light guide, at least with respect to one transverse axis thereof. In this manner, the normal diffusing of underwater lighting encountered in water displays caused by ripples in the pool are avoided because of the upper surface of the light guide being above the water level. The net result is that light passing directly from the light source to the eyes of the display observer is held to a minimum, as is the intermixing of light from multiple light sources, thereby making the light sources substantially invisible to the observer and allowing illumination of the water display with multiple lights of different colors in a pleasing and effective manner. Various embodiments are disclosed.

DETAILED DESCRIPTION OF THE INVENTION

Figure 1:
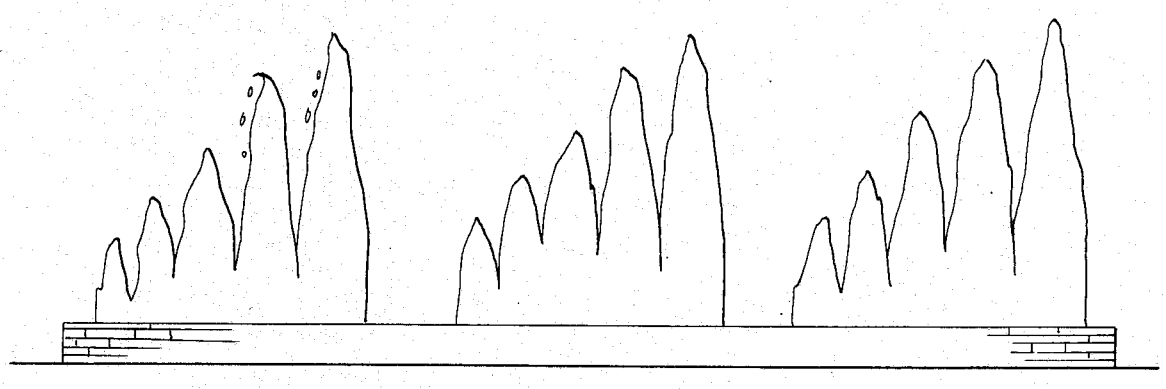
FIG. 1 is an illustration of a water fountain or display of the general type for which the present invention is useful.

First referring to FIG. 1, an illustration of the general type of fountain which may advantageously utilize the present invention may be seen. The particular fountain illustrated comprises a plurality of vertically directed nozzles, controllable either individually or in groups through some form of automatic control to generate a constantly changing pattern. Fountains of this general type may utilize a linear array of nozzles or two dimensional array to achieve the desired result. This type of fountain, as well as many others, used for decorations of buildings, shopping centers and the like, are characterized by some form of pool of water from which the water display rises, with lighting for night enjoyment of the water display being provided by lights disposed beneath the surface of the pool.

Because of the air bubbles in the water display, light generally will not transmit well through the display but rather is reflected in a rather diffuse manner from the surface and near surface regions of the water display. Because of this effect, the water in the display cannot be effectively illuminated from immediately below, but instead lighting must be provided the display from the side or sides of the display to be viewed. Accordingly, water displays arising from a pool are generally lighted using lights below the surface of the water positioned somewhere generally between the observer and the water display itself, giving rise to the problems heretofore discussed, namely some transmission of light through the water surface directly to the observer's eye, creating a veiling glare below the water display, and, in a similar manner, causing illumination of any part of the water display by light from a plurality of individual lights, whereby separate colors will intermix.

Figure 2:
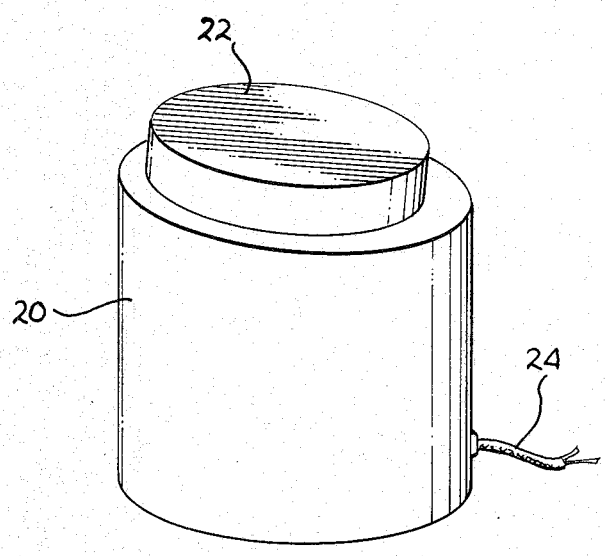
FIG. 2 is a perspective view of one embodiment light source of the present invention.

Now referring to FIG. 2, a perspective view of a light in accordance with the present invention may be seen. In this embodiment, the light is characterized by a can-like enclosure 20 for fastening to the bottom of the fountain pool in an appropriate location, a light baffle 22 thereover and a power line 24 coming therefrom. Details of the structure of the light may be seen in FIG. 3, which is a cross section taken along line 3—3 of FIG. 2. Mounted within the enclosure 20 is a gimbal member 26 supported at diametrically opposite positions from the enclosure 20 on axis 28 so as to allow member 26 to be adjusted about axis 28 to any desired position. Supported from member 26 in turn is an enclosure 30 containing a high intensity bulb and reflector of a conventional design, which together provides fairly well collimated light along axis 32 of the structure. Sealing the top of enclosure 30 is a flat plate lens 34, sealably fastened to the periphery of enclosure 30 by screws 36 so as to allow the removal thereof for the changing of the bulb when necessary.

Figure 4:
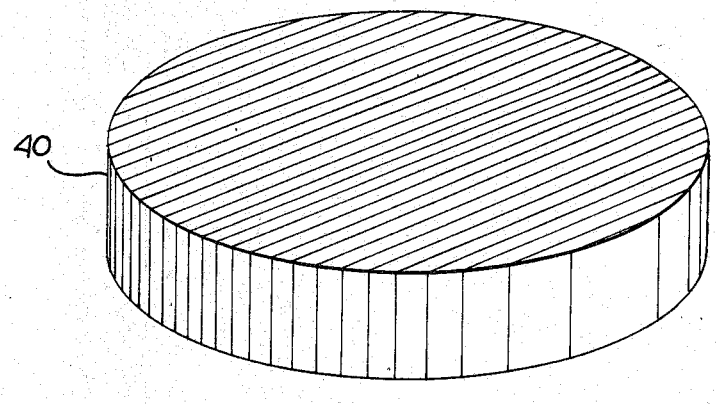
FIG. 4 is a perspective view of the light guide used with the light of FIGS. 2 and 3.

At the top of enclosure 20, the circular opening 38 is covered by light baffle 40, an important element of the invention. Details of the light guide or baffle 40 may be seen in FIGS. 4 and 5. To fabricate the light baffle, a plurality of individual baffle plates 42 (FIG. 5) are prepared from clear acrylic. The individual plates, before or after being cut from a sheet thereof, are sandblasted on opposite surfaces 44 and 46 thereof and are then either painted black on these opposite surfaces and cemented together, or alternatively, cemented together in a stack as shown in FIG. 4 using a black adhesive. In this particular embodiment the upper and lower surfaces are polished and the periphery finished to provide a baffle plate approximately 10 inches in diameter and two inches thick.

Figure 3:
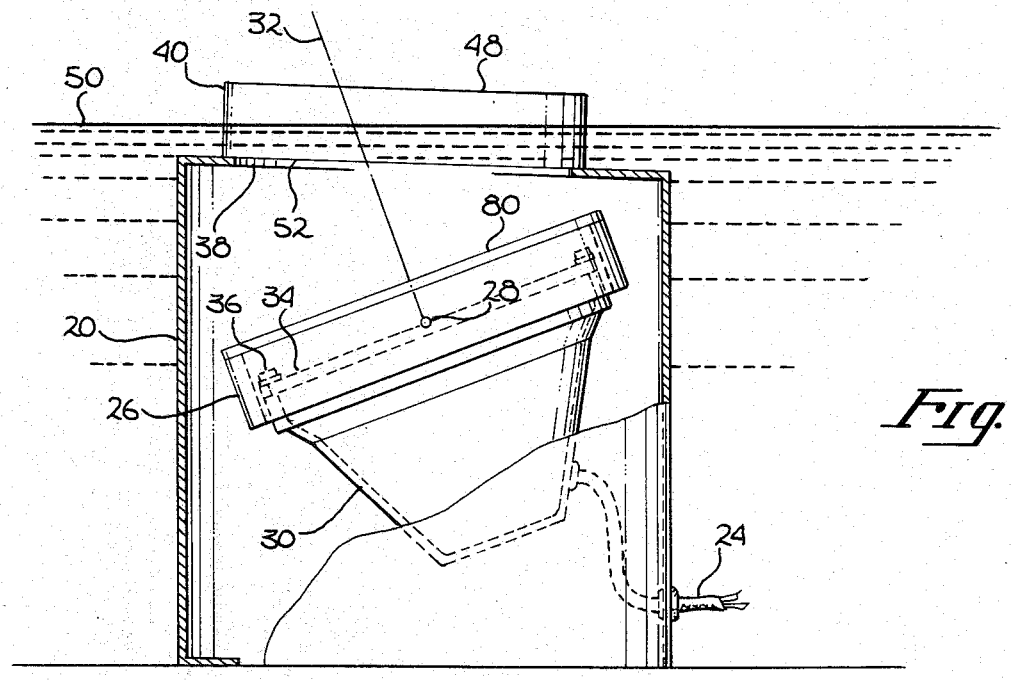
FIG. 3 is a partial cross section of the light of FIG. 2 taken along line 3—3 thereof.

As may be seen in FIG. 3, the baffle 40 is positioned at the top of enclosure 20 with the top surface 48 thereof being at an elevation above the normal pool water level 50 and with the bottom surface 52 thereof below the normal water level 50. In this manner, the light from the light source therebelow does not pass through a water-air interface, but rather passes through a water-baffle interface and then a baffle-air interface. Accordingly, ripples on the surface of the pool are fully isolated from the light path of the light source to the water display by the baffle 40, and therefore cannot disburse the light as inevitable with the prior art systems.

Light sources illuminating a water display frequently are positioned somewhat close to the display, and of course, many displays have at least some water showering outward from their central region so that some water droplets may impinge directly on the top surface 48 of the baffle, or splash thereon from the adjacent pool. For this purpose, the baffle is preferably tilted about an axis parallel to axis 28 so that while water may impinge on the top surface thereof, it will not tend to collect there but rather will tend to run off in a rather uniform thin sheet. Thus while the impinging droplets, or for that matter any droplets in the air in the path of the light beam will have some tendency to disperse the light, the effect will be a very localized effect, as water cannot collect on the top surface of the baffle in sufficient thickness for ripples therein to propagate significantly beyond the size of the impinging droplet itself, and of course even the disturbance made by a droplet impinging on the baffle surface is only a momentary disturbance.

The amount of tilt of the top surface of the baffle is of course somewhat a matter of choice. Since the level of fountain pools is normally well controlled, it has been found that the two inch thickness of the baffle of the preferred embodiment is adequate to allow sufficient tilting of the baffle for proper water runoff without lowering one edge of the baffle below water level or raising the other edge out of the water. Also, as may be seen in FIG. 3, the baffle may in effect be tilted toward the observer even though the light itself is tilted toward the display, as very little light will proceed directly toward the viewer's eyes even with such tilting, and the tilting of the baffle toward the viewer lowers the visible edge of the baffle toward the pool surface to make the light source even less apparent to those enjoying the water display.

Figure 6:
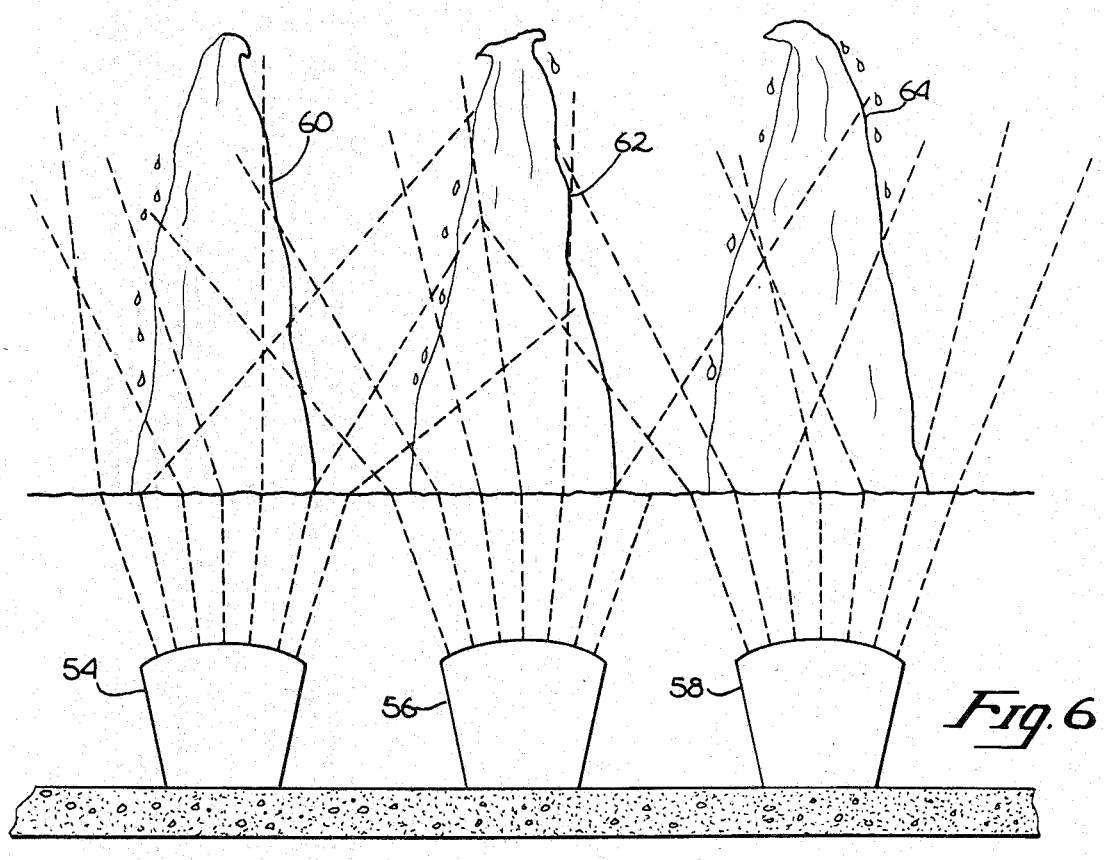
FIGS. 6 and 7 are figures illustrating problems characteristic with prior art lighting systems and the solution provided by the present invention, respectively.
Figure 7:
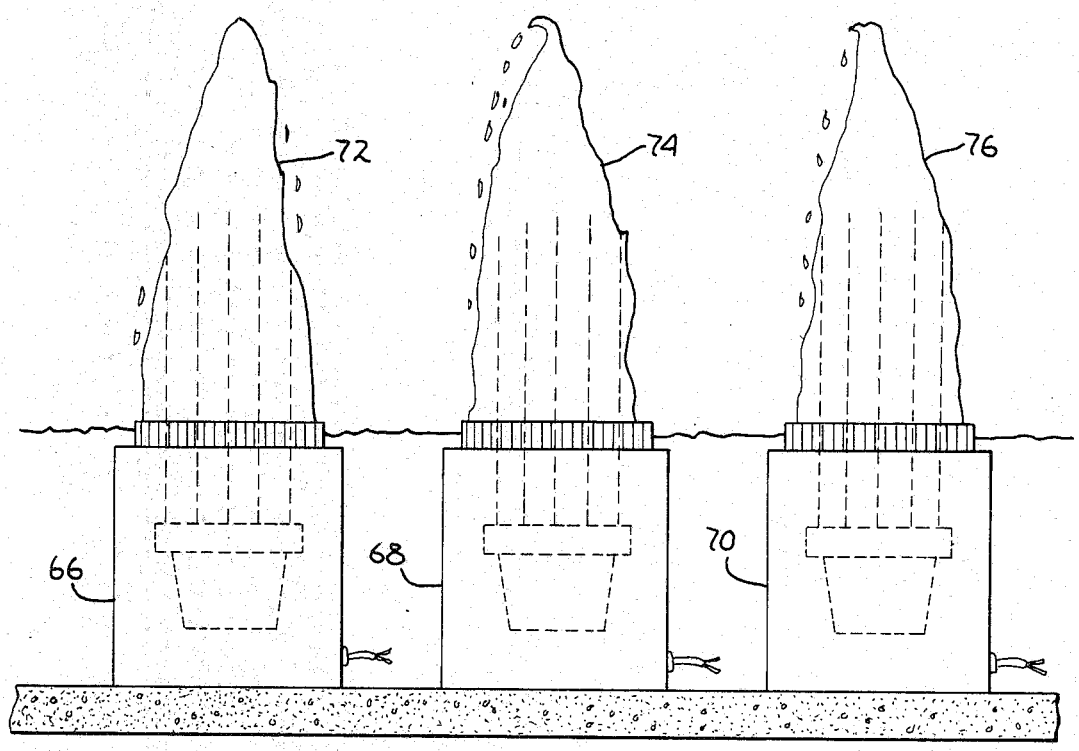

The effect of the use of the present invention is perhaps best illustrated by comparing FIGS. 6 and 7. In FIG. 6 a prior art lighting system is illustrated wherein three individual lights 54, 56 and 58 are disposed below and forward of individual fountain portions 60, 62 and 64 respectively, intending that each light illuminate each respective column. The divergence of the light coming from the light sources 54 through 58 however, coupled with the natural ripple pattern on the surface of the pool caused by the fountain result in substantial dispersion of the light from each of the light sources, some of that dispersion directing the light to the eyes of the observer and some merely causing an intermixing of the light from the various light sources thereby preventing the effective use of lights of different color for any adjacent fountain portions.

With the present invention however, as may be seen in FIG. 7, the light from light sources 66, 68 and 70 illuminates fountain portions 72, 74 and 76 respectively with no meaningful dispersion of light toward the observer and with no significant intermixing of the light from the individual sources. In that regard it may be seen from FIG. 7 that the effect of the structure of the baffle illustrated in FIGS. 4 and 5, and the X, Y, Z coordinate system referenced to the structure of the baffle as illustrated in FIG. 4, is to allow light to pass in the Z direction, and in directions inclined with respect to the Z axis in the X-Z plane. This will allow the setting of the focus of the light sources and the directing of the light so as to illuminate the full height of any individual portion of the water display. However, light inclined from the Z axis in the Y-Z plane, or referenced to FIG. 7, light inclined toward the area intended to be illuminated by the adjacent light source, will be intercepted by the baffle. Accordingly, the embodiment hereinbefore described assures excellent collimation of the light about one axis to avoid intermixing of light from adjacent light sources, yet allows the controlled spreading of the light about a transverse axis to appropriately illuminate the full length of the water display, while at the same time avoiding large dispersions about that same axis to avoid any glare in the observer's eyes by eliminating the water surface ripple dispersion effect.

Figure 8A:
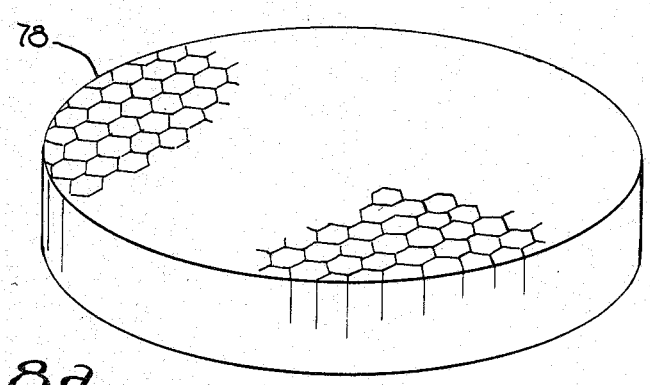
FIGS. 8*a* and 8*b* are views of an alternate embodiment light guide.

In certain other applications it may be desired to illuminate a relatively local area of a water display. Accordingly, a high degree of collimation of the light about both axes may be desired. In such event a honeycomb-like light baffle may be fabricated as shown in FIG. 8*a* as baffle 78. Such a structure could be readily manufactured by sandblasting and painting hexagonal bars of acrylic, slicing the bars, as shown in FIG. 9*b* cementing them together and finishing the baffle surfaces. One could also pour a clear resin over a honeycomb structure, appropriately blackened, to achieve the same result, though for outdoor use a resin having both the appropriate clarity and ultraviolet light resistance would be required. In some applications one might even use an open honeycomb structure with the upper portion disposed above the water surface and the lower portion disposed below the water surface, as such a structure would be effective in eliminating propagation of ripples between cells. Such a structure would not provide the performance of the present invention however, as it would appear much more obtrusive, and the meniscus surrounding the walls of each cell would themselves be expected to act as a lens to diffuse the light, resulting both in some loss of light and dispersion of the remaining light, both in amounts dependent upon the size of the cells and the length of the cells extending above the meniscus.

Figure 5:
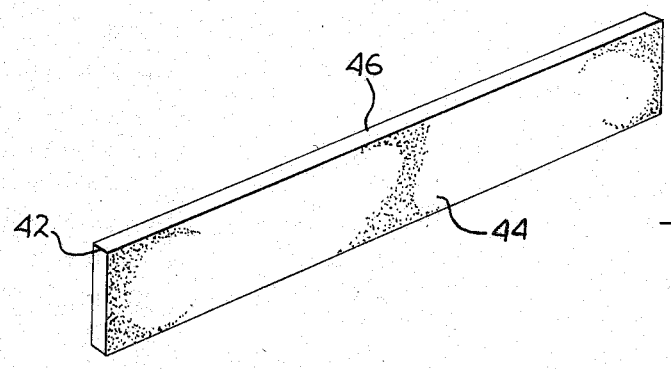
FIG. 5 is a perspective view of an individual strip of the type used to fabricate the guide of FIG. 4.
Figure 10B:
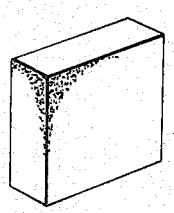
FIG. 10*a* and 10*b* are views of a still further alternate embodiment light guide and a typical element thereof.
Figure 10A:
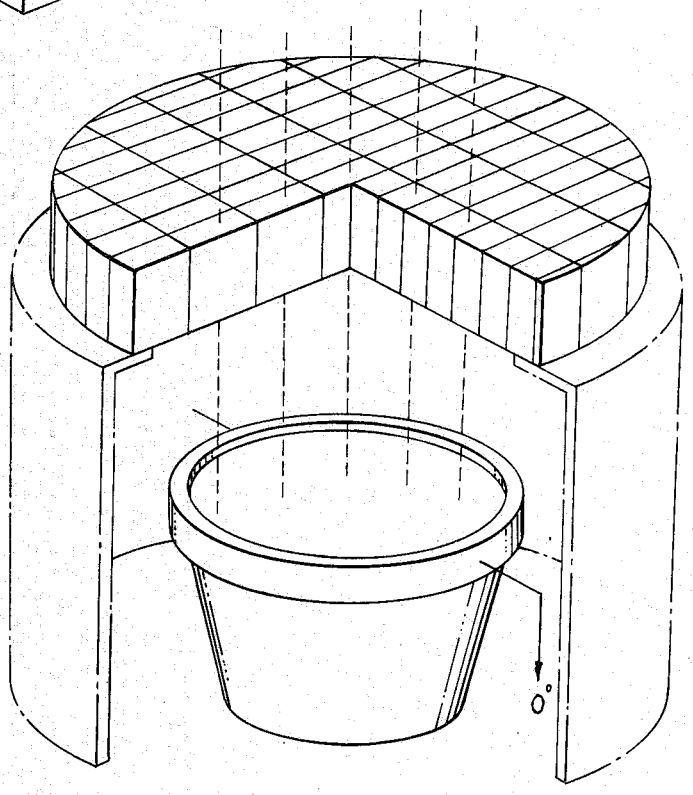

Finally, a still further ultimate embodiment is illustrated in FIG. 10*a*. This embodiment may readily be fabricated in the same manner as the embodiment of FIGS. 3 and 4, though with certain additional steps before finishing the periphery and faces of the baffle. In particular, after the individual baffle plates of FIG. 5 are blackened and cemented together to form the basic structure of FIG. 4, the resulting structure may be sliced in an orthogonal (Y) direction, slicing the structure into individual slices having a thickness equal to, or as shown in FIG. 10*a* is different from the thickness of the individual baffles 42 of FIG. 5. These slices then would themselves be blackened on the sliced area, and cemented, and/or cemented together with a black adhesive to provide the structure shown, each element thereof being as shown in FIG. 10*b*. Such a structure has the advantage of assuring the desired collimation about two axes, though which collimation may for various reasons be desired to be different. By way of specific example, one might desire significant, though carefully controlled dispersion about one axis so as to illuminate the full height of a water display region, yet have no substantial dispersion to the sides so as to avoid intermixing of adjacent colors.

Figure 8B:
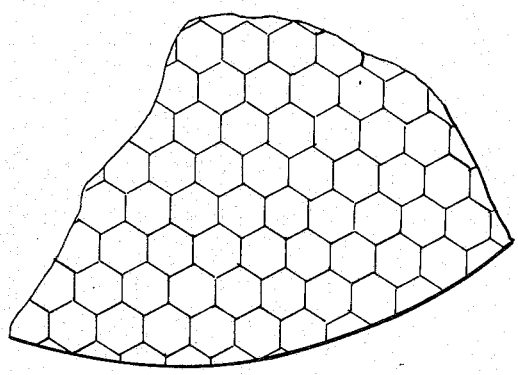
Figure 9A:
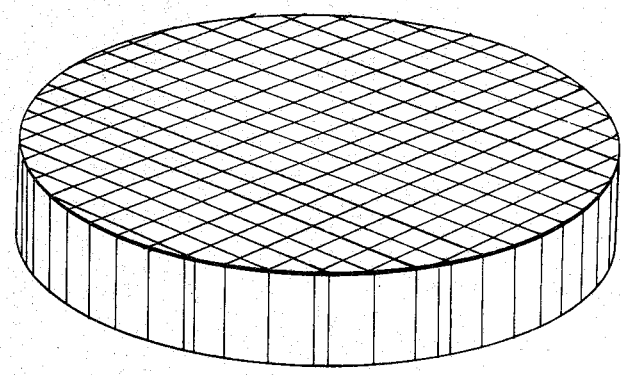
FIGS. 9*a* and 9*b* are views of a further alternate embodiment light guide and a typical element thereof.
Figure 9B:
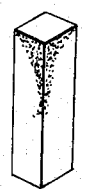

The light baffles of FIGS. 8 and 9 are both quite directional with respect to the passage of light therethrough and accordingly, the cells therein must be directionally oriented properly, with the cells being generally in line with the axis of the light source itself as illustrated in FIG. 10. Obviously however, it should be noted that with either of these two embodiments, or for that matter, the original embodiment disclosed, the cells and/or plates making up the baffle may be inclined with respect to the surfaces of the finished baffle as desired by merely cementing the parts together at an incline before finishing the surfaces of the baffle. Further, of course, opposite surfaces of the baffle not only need not be perpendicular to the cells or plates therein but in fact don't even have to be parallel to each other as long as the effect of the nonparallel surfaces is appropriately taken into account when setting up the system, though parallel surfaces of course are preferred for ease of fabrication, etc.

With respect to the use of colors for illuminating water fountains, it has been found that the present invention also facilitates the use of colored translucent plastic panels to obtain the desired color. In particular, a colored translucent panel 80 may be disposed over the light source as shown in FIG. 3 to obtain the desired colored light. By spacing the panel away from the lens plate over the light source, adequate water cooling of the plastic panel is obtained to avoid overheating, distortion, burning or other deterioration over long periods of time. This has great advantages over the prior art, as heretofore special colored glass panels were required to achieve the same result. Aside from the problems of cost and availability of such prior art panels, the panels are available in any event in very limited colors, whereas colored translucent plastic panels suitable for use of the present invention are readily commercially available in a wide variety of colors, tints, etc.

There has been disclosed and described herein various embodiments of water display lights which provides lighting which is much less obtrusive to the observer and which has numerous other advantages including much more readily facilitating lighting of individual parts of a water display with various colors. Obviously while the invention has been disclosed and described with respect to various preferred embodiments, it will be understood by those skilled in the art that various changes in form and detail may be made therein without departing from the spirit and scope thereof.

We claim:

1. An underwater lighting system for illuminating an object above the surface of water from a light source under the water surface comprising a light source means disposed below the water surface to direct light toward the object to be illuminated above the water surface; and a baffle means having an upper surface and a lower surface and being disposed in the path of the light from said light source to the object to be illuminated, said upper surface of said baffle means being disposed above the water surface and said lower surface of said baffle means being disposed below the water surface, said baffle means being a means for allowing light from said light source to pass therethrough in a predetermined first direction, and to inhibit the passage of light therethrough in directions deviating from said first direction, at least about a first axis.

2. The lighting system of claim 1 wherein said baffle means is also a means for inhibiting the passage of light therethrough in directions deviating from said first direction about a second axis orthogonal to said first axis.

3. The lighting system of claim 2 wherein said baffle has substantially symmetrical light transmission characteristics to inhibit the passage of light therethrough deviating from said first direction in substantially equal amounts, whether about said first axis or about said second axis.

4. The lighting system of claim 2 wherein said baffle has substantially unsymmetrical light transmission characteristics to inhibit the passage of light deviating from said first direction about said first axis substantially more than light deviating by the same angle from said first direction direction about said second axis.

5. The lighting system of claim 1 wherein said baffle means comprises a solid transparent member having a plurality of opaque surfaces extending between said upper surface and said lower surface to define a preferred light path therethrough.

6. The lighting system of claim 5 wherein said solid transparent member comprises a plurality of transparent plastic members separated by blackened surfaces therebetween.

7. The lighting system of claim 5 wherein said upper surface of said baffle means is inclined from the horizontal, whereby water impinging thereon will not collect on said upper surface.

8. The lighting system of claim 1 wherein said light source means has a flat lens thereon.

9. The lighting system of claim 1 wherein said light source means includes a light mounted within and gimbaled with respect to an enclosure, said baffle means being supported by said enclosure.

10. The lighting system of claim 9 further comprised of means for supporting a sheet of colored plastic between said light source means and said baffle.

11. The lighting system of claim 1 further comprised of means for supporting a sheet of colored plastic between said light source means and said baffle.

12. The lighting system of claim 11 wherein said means for supporting a sheet of colored plastic between said light source means and said baffle is a means for supporting a sheet of colored plastic in a position spaced from said baffle and said light source means, whereby said sheet of colored plastic will be immersed in and cooled by water.

13. A method of illuminating an object above the surface of water from a light source under the water surface comprising the steps of (a) providing a light source under the surface of the water and directing the light therefrom toward the object to be illuminated (b) providing a transmitting member in the light path from the light source with the upper surface of the transmitting member above the surface of the water and the lower surface of the member below the surface of the water, the transmitting member being substantially transparent to light, at least directed along the light path, whereby light may pass directly through the transmitting member along the light path without being deflected by ripples on the surface of the water adjacent to the transmitting member.

14. The method of claim 13 wherein the transmitting member allows light from said light source to pass therethrough along the light path direction directly from the light source, and to inhibit the passage of light therethrough in directions deviating from the light path direction, at least about a first axis.

15. The method of claim 14 wherein the transmitting member also inhibits the passage of light therethrough in directions deviating from the light path direction about a second axis orthogonal to said first axis.

16. The method of claim 14 wherein the transmitting member is a solid transparent member having a plurality of opaque surfaces extending between the upper surface and said lower surface thereof to define a preferred light path therethrough.

17. The method of claim 16 wherein the upper surface of the transmitting member is inclined from the horizontal, whereby water inpinging thereon will not collect on the upper surface.

18. The method of claim 13 further comprised of the steps of supporting a sheet of colored plastic between the light source means and the transmitting member.

19. The method of claim 18 wherein the colored plastic sheet is supported so as to be surrounded by water.

* * * * *